US008201283B2

(12) United States Patent
Ciski et al.

(10) Patent No.: US 8,201,283 B2
(45) Date of Patent: Jun. 19, 2012

(54) TOILET TANK VALVE STRUCTURE

(76) Inventors: Andras Ciski, Pompano Beach, FL (US); Xian Jin Jeff Zhang, Fujian (CN)

( * ) Notice: Subject to any disclaimer, the term of this patent is extended or adjusted under 35 U.S.C. 154(b) by 1017 days.

(21) Appl. No.: 12/139,279

(22) Filed: Jun. 13, 2008

(65) Prior Publication Data

US 2009/0307833 A1 Dec. 17, 2009

(51) Int. Cl.
*E03D 3/12* (2006.01)

(52) U.S. Cl. ..... 4/325; 4/327

(58) Field of Classification Search ..... 4/415, 417, 4/324–326, 363, 364, 368, 373, 327
See application file for complete search history.

(56) References Cited

U.S. PATENT DOCUMENTS 4,225,987 A * 10/1980 Goldman et al. ..... 4/325
4,406,024 A * 9/1983 Chiu et al. ..... 4/324
4,411,029 A * 10/1983 Huang ..... 4/324
4,624,018 A * 11/1986 Kurtz ..... 4/325
4,750,220 A * 6/1988 Baumann ..... 4/324
4,837,867 A * 6/1989 Miller ..... 4/324
5,070,547 A * 12/1991 Comparetti ..... 4/325
5,400,445 A * 3/1995 Hull ..... 4/325
6,898,808 B2 * 5/2005 Molho et al. ..... 4/325
7,159,251 B2 * 1/2007 Hennessy ..... 4/328
7,591,027 B2 * 9/2009 Scruggs ..... 4/327

* cited by examiner

*Primary Examiner* — Korie Chan
(74) *Attorney, Agent, or Firm* — Haverstock & Owens LLP

(57) ABSTRACT

A toilet tank valve structure comprises a knob unit, a rotatable shaft unit, a pole unit, a whole discharge pull wire, a partial discharge pull wire, a whole discharge assembly, a partial discharge assembly, and a water seal; the knob unit comprising a partial discharge knob and a whole discharge knob; the rotatable shaft unit comprising a shaft core and a shaft sleeve; the pole unit comprising a partial discharge pole and a whole discharge pole; the whole discharge knob being secured to an outer end of the shaft sleeve, an inner end of the shaft sleeve being secured to a first end of the whole discharge pole, a second end of the whole discharge pole being connected to the whole discharge pull wire to link the whole discharge assembly and the water seal; the partial discharge knob being secured to an outer end of the shaft core, the shaft core being inserted into the shaft sleeve, an inner end of the shaft core being secured to a first end of the partial discharge pole, a second end of the partial discharge pole being connected to the partial discharge pull wire to link the partial discharge assembly and the water seal. This structure is convenient for installation and operation.

7 Claims, 13 Drawing Sheets

TOILET TANK VALVE STRUCTURE

BACKGROUND OF THE INVENTION

1. Field of the Invention

The present invention relates to a toilet tank valve structure, and more particularly to a structure to control a knob and having a limiting device for a partial discharge.

2. Description of the Prior Art

As shown in FIG. 1, a conventional toilet tank valve comprises a knob 10, a rotatable shaft 20, a pole 30, first and second pull wires 40, a whole discharge assembly 50, a partial discharge assembly 60, and a water seal 70. When the knob 10 is turned clockwise or contraclockwise, the rotatable shaft 20 will link the pole 30 to turn clockwise or contraclockwise so as to pull the first or second pull wire 40 to lift the water seal 70 at different levels, releasing a whole discharge or a partial discharge.

The above-mentioned structure has the following disadvantages:

1. The knob 10 is operated at two different directions to release a whole discharge or a partial discharge, which is easy to cause a confusion to turn the wrong direction.
2. It is necessary to provide enough space for clockwise or contraclockwise rotation of the knob 10, therefore, the installation of the knob is limited and not convenient.
3. The front of the toilet tank is provided with a toilet cover. Due to the toilet cover, the knob 10 is not suitable for installing at the front of the toilet tank. Usually, the knob 10 is installed at one side of the toilet. The knob 10 tends to hit the wall easily when the knob 10 is turned toward the wall, which is not convenient to operate the knob 10.
4. When the knob 10 is installed at one side of the toilet tank, people are used to turn the knob outward not inward, which is unable to achieve two-stage function and is easy to have a wrong operation.
5. The whole discharge or the partial discharge depends on the whole discharge assembly 50 or the partial discharge assembly 60. The knob 10 doesn't have a partial discharge limit mechanism itself, which is not easy for a user to identify the whole discharge or the partial discharge by hand.

SUMMARY OF THE INVENTION

The primary purpose of the present invention is to provide a toilet tank valve structure to improve the structure of a knob, which is convenient for installation and operation.

The second purpose of the present invention is to provide a toilet tank valve structure, which provides a limiting device for a partial discharge.

To achieve the above-mentioned purposes of the present invention, there is provided a toilet tank valve structure comprising a knob unit, a rotatable shaft unit, a pole unit, a whole discharge pull wire, a partial discharge pull wire, a whole discharge assembly, a partial discharge assembly, and a water seal; the knob unit comprising a partial discharge knob and a whole discharge knob; the rotatable shaft unit comprising a shaft core and a shaft sleeve; the pole unit comprising a partial discharge pole and a whole discharge pole; the whole discharge knob being secured to an outer end of the shaft sleeve, an inner end of the shaft sleeve being secured to a first end of the whole discharge pole, a second end of the whole discharge pole being connected to the whole discharge pull wire to link the whole discharge assembly and the water seal; the partial discharge knob being secured to an outer end of the shaft core, the shaft core being inserted into the shaft sleeve, an inner end of the shaft core being secured to a first end of the partial discharge pole, a second end of the partial discharge pole being connected to the partial discharge pull wire to link the partial discharge assembly and the water seal.

Preferably, the partial discharge assembly comprises a body, an inner tube, a swing hook, a floating rod, and a partial discharge float, the partial discharge float being disposed on the floating rod, the floating rod being inserted in the body in an up and down movable way, a first end of the swing hook being pivotally connected to the floating rod, a second end of the swing hook being pivotally connected to an inner wall of the body, the swing hook and the inner tube being provided with corresponding limiting steps; a limiting device being provided between the partial discharge pull wire and the partial discharge assembly, the limiting device comprising a brake rod and a limiting hook, one side of the brake rod being pivotally connected on the inner tube, another side of the brake rod being connected to the partial discharge pull wire and the limiting hook, an upper end of the limiting hook being pivotally connected to the inner tube, a lower end of the limiting hook being formed with a hooking part, the inner wall of the body being provided with a protruding step for engagement of the hooking part.

Preferably, an engaging base is provided on the top of the brake rod and an engaging claw is provided on the engaging base, an engaging hole being formed between the engaging claw and the engaging base for insertion of a lower end of the partial discharge pull wire.

Preferably, the whole discharge knob is integrally formed with the shaft sleeve.

Preferably, the partial discharge knob is outward stacked on the whole discharge knob, and the whole discharge knob has an arm longer than an arm of the partial discharge knob.

Preferably, the rotatable shaft unit is inserted into a control box, a pair of torque springs being provided between the shaft core and an inner wall of the control box and between the shaft sleeve and the inner wall of the control box, respectively, the torque springs being adapted to link the shaft core and the shaft sleeve to return their original positions.

Preferably, the whole discharge assembly comprises a body, an inner tube, and a whole discharge float, the inner tube and the whole discharge float being assembled in the body, the whole discharge float fitting onto the inner tube, the whole discharge float having one side pivotally connected to an inner wall of the body, the whole discharge float and the inner tube being provided with corresponding limiting steps, the whole discharge pull wire being connected to an upper end of the inner tube, the bottom of the inner tube being mounted onto the water seal.

Preferably, the top of the inner tube is provided with an engaging base and an engaging claw is provided on the engaging base, an engaging hole being formed between the engaging base and the engaging claw for insertion of a lower end of the whole discharge pull wire.

Accordingly, when a whole discharge is desired, the whole discharge knob is rotated to link the whole discharge pull wire, the whole discharge assembly, and the water seal is lifted to a higher position to achieve the whole discharge; when a partial discharge is desired, the partial discharge knob is rotated to link the partial discharge pull wire, the partial discharge assembly, and the water seal is lifted to a lower position to achieve the partial discharge.

DETAILED DESCRIPTION OF THE INVENTION

Figure 1:
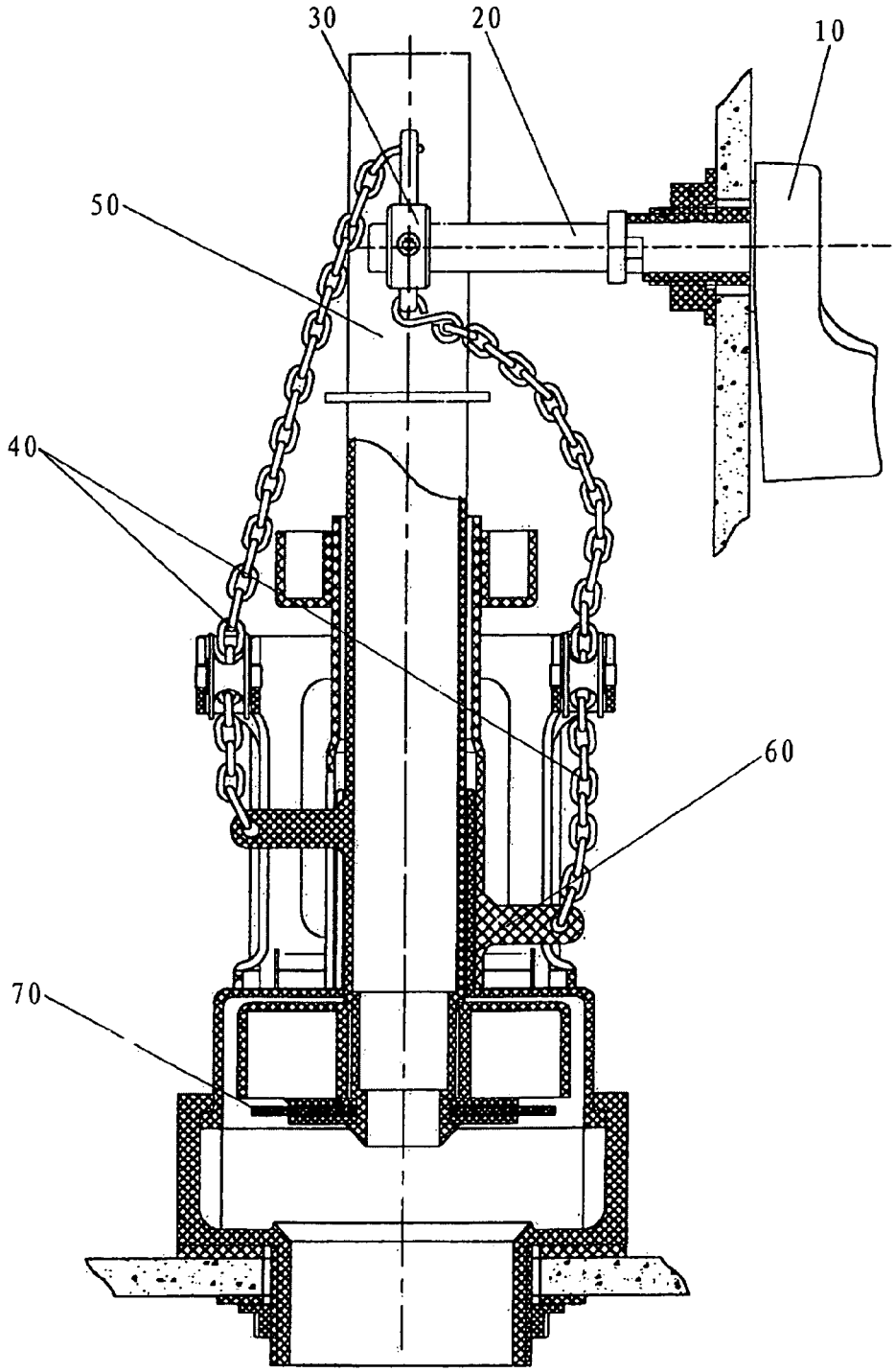
FIG. 1 Prior Art
FIG. 1 is a side view of a conventional toilet tank valve; partially in cutaway cross-section.
Figure 2:
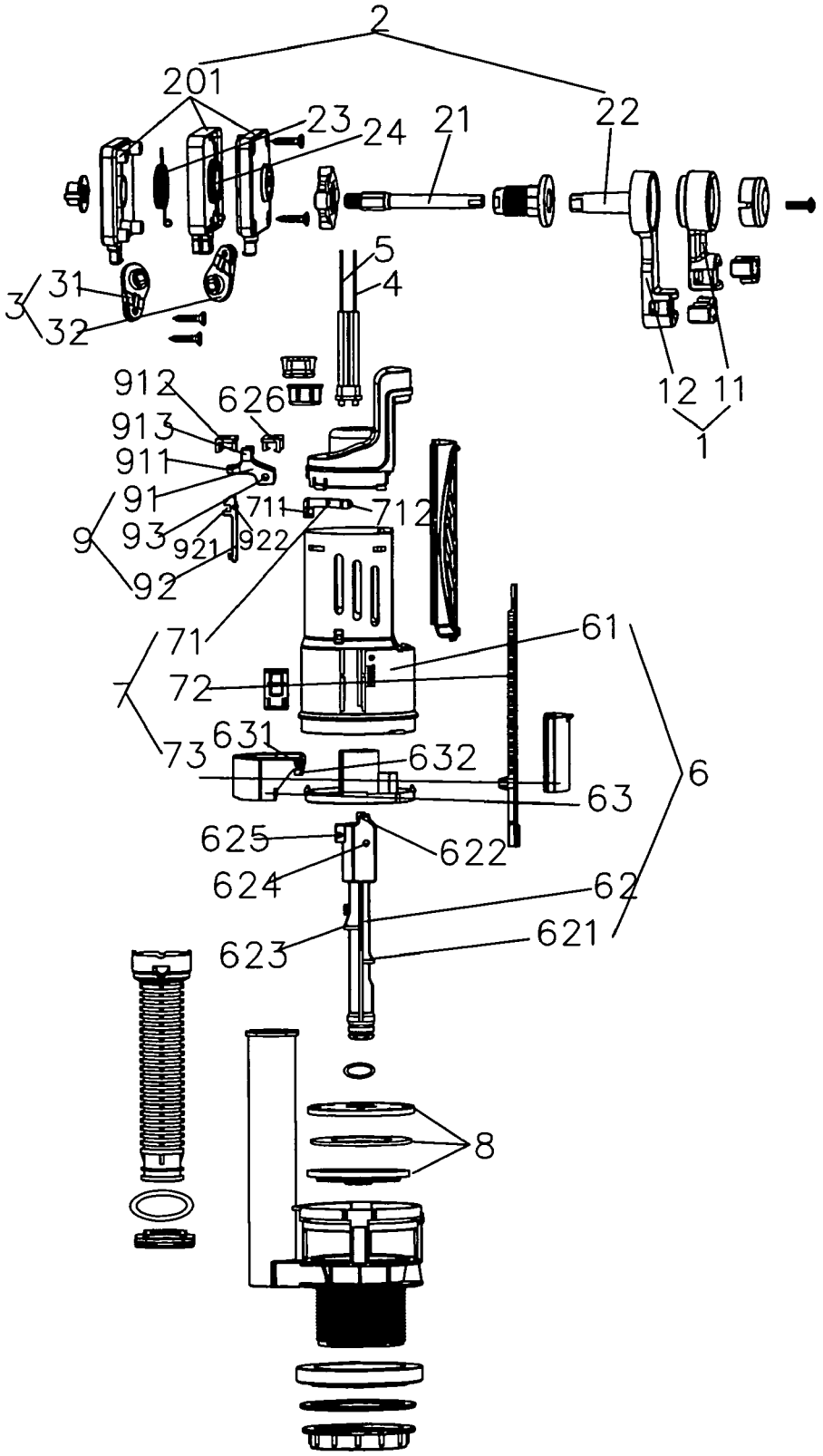
FIG. 2 is an exploded view of the present invention.
Figure 3:
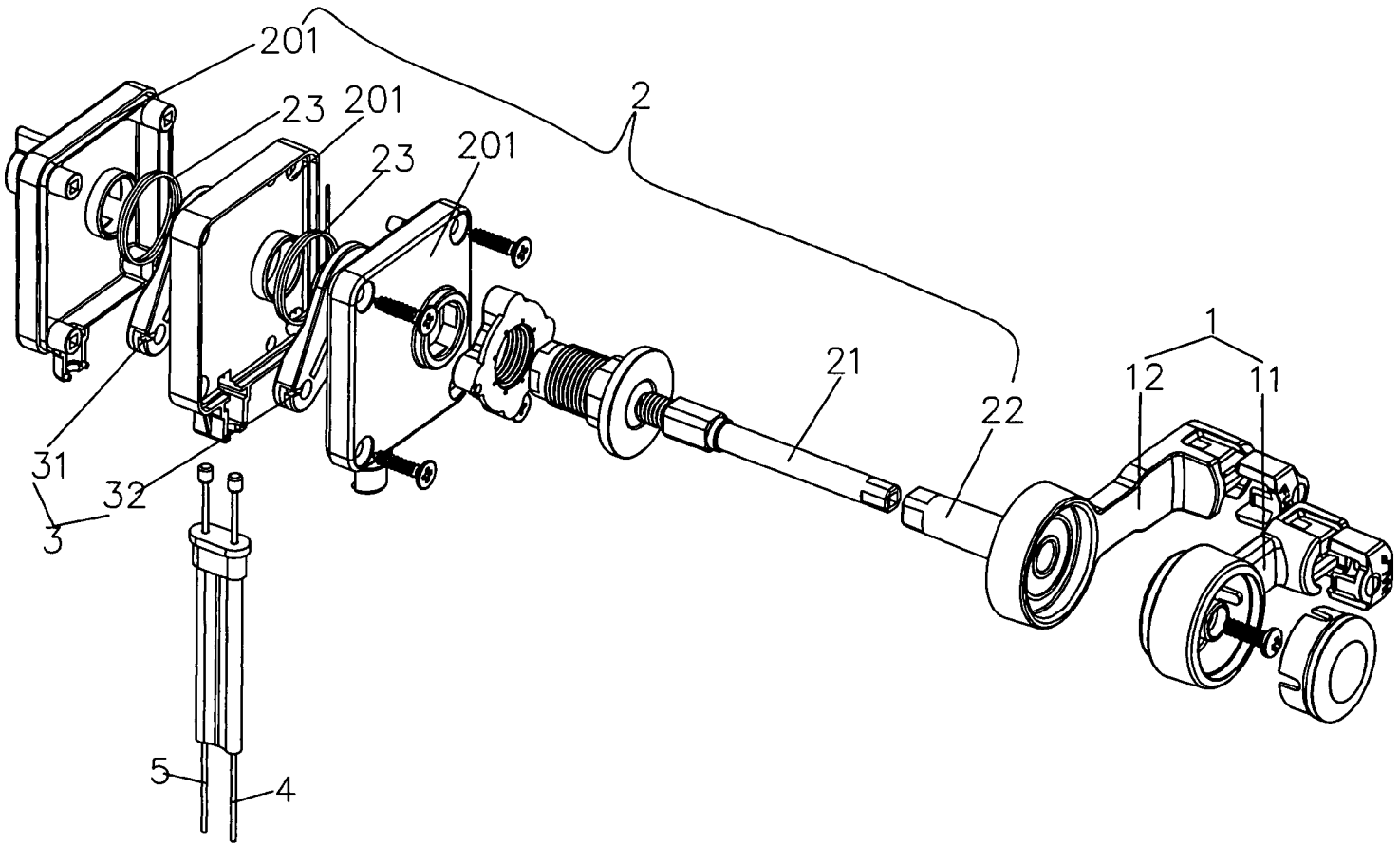
FIG. 3 is an exploded and enlarged view of the present invention.

As shown in FIGS. 1 through 4, a toilet tank valve structure according to a preferred embodiment of the present invention comprises a knob unit 1, a rotatable shaft unit 2, a pole unit 3, a whole discharge pull wire 4, a partial discharge pull wire 5, a whole discharge assembly 6, a partial discharge assembly 7, and a water seal 8.

The knob unit 1 comprises a partial discharge knob 11 and a whole discharge knob 12.

The rotatable shaft unit 2 comprises a shaft core 21 and a shaft sleeve 22.

The pole unit 3 comprises a partial discharge pole 31 and a whole discharge pole 32.

The whole discharge knob 12 is secured to an outer end of the shaft sleeve 22. In this embodiment, the whole discharge knob 12 is integrally formed with the shaft sleeve 22. An inner end of the shaft sleeve 22 is glued fixedly or connected to a first end of the whole discharge pole 32 by means of a non-circular (such as rectangular) locating insertion, as shown in this embodiment. A second end of the whole discharge pole 32 is connected to an upper end of the whole discharge pull wire 4. The whole discharge pull wire 4 is adapted to link the whole discharge assembly 6 and the water seal 8 to achieve a whole discharge, as shown in FIGS. 5 and 12.

Figure 6:
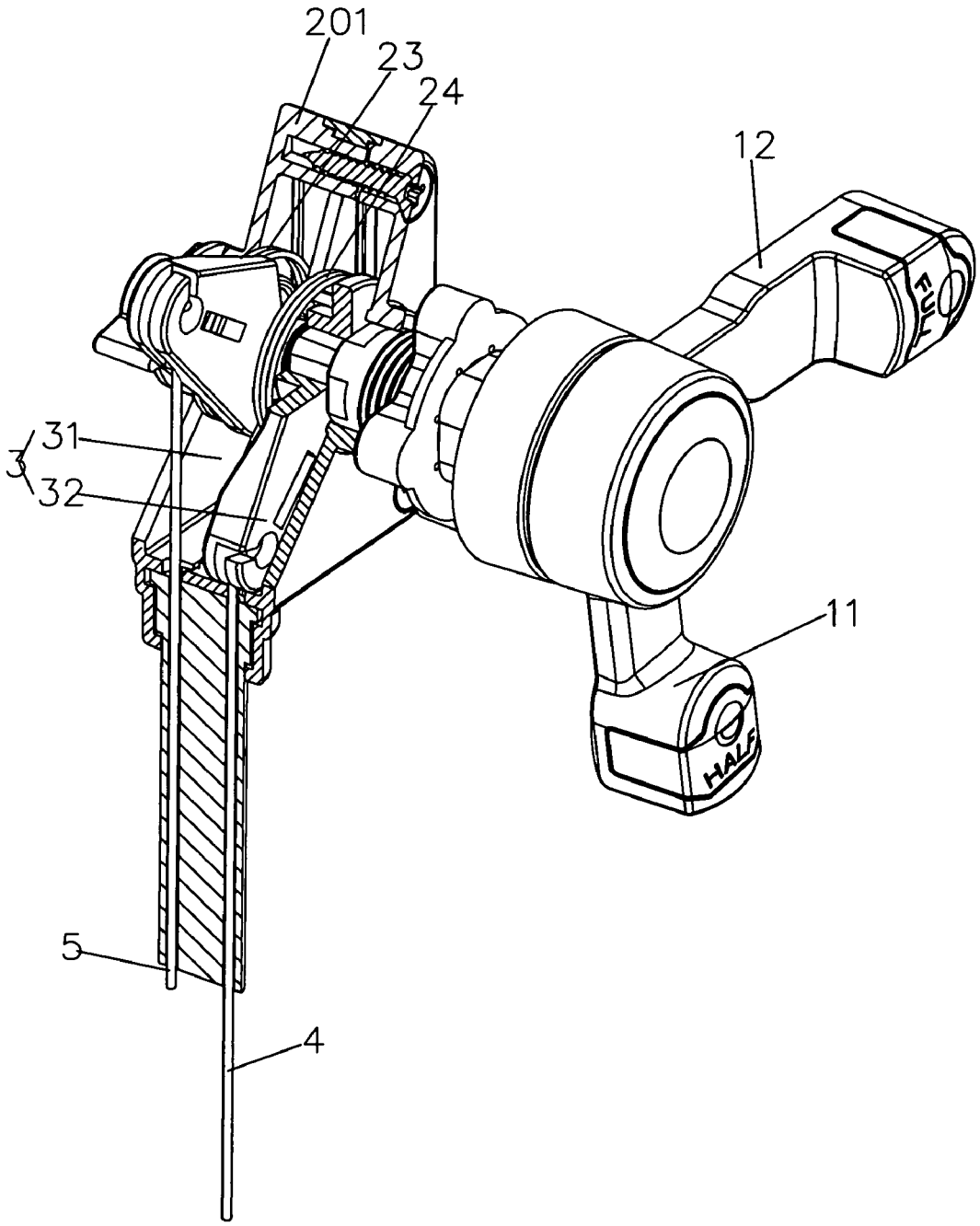
FIG. 6 is an assembled view of the present invention in an operating state for a partial discharge, partially sectioned.
Figure 13:
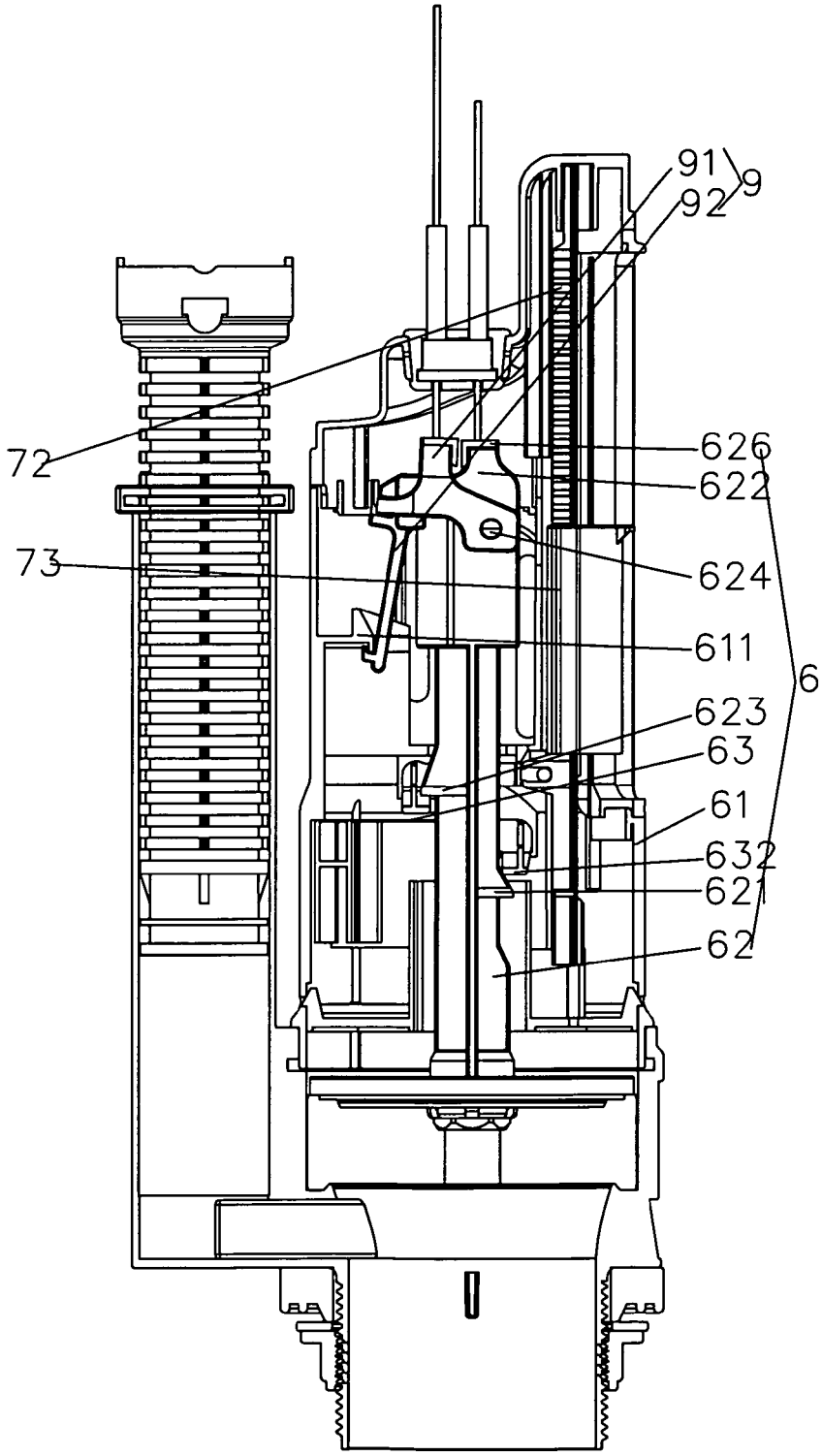
FIG. 13 is a partial view of the present invention in an operating state for a partial discharge.

The partial discharge knob 11 is glued fixedly or connected to an outer end of the shaft core 21 by means of screws and a non-circular (such as rectangular) locating insertion. The shaft core 21 is inserted into the shaft sleeve 22. An inner end of the shaft core 21 is glued fixedly or connected to a first end of the partial discharge pole 31 by means of non-circular (such as rectangular) locating insertion, as shown in this embodiment. A second end of the partial discharge pole 31 is connected to an upper end of the partial discharge pull wire 5. The partial discharge pull wire 5 is adapted to link the partial discharge assembly 7 and the water seal 8 to achieve a partial discharge, as shown in FIGS. 6 and 13.

Figure 4:
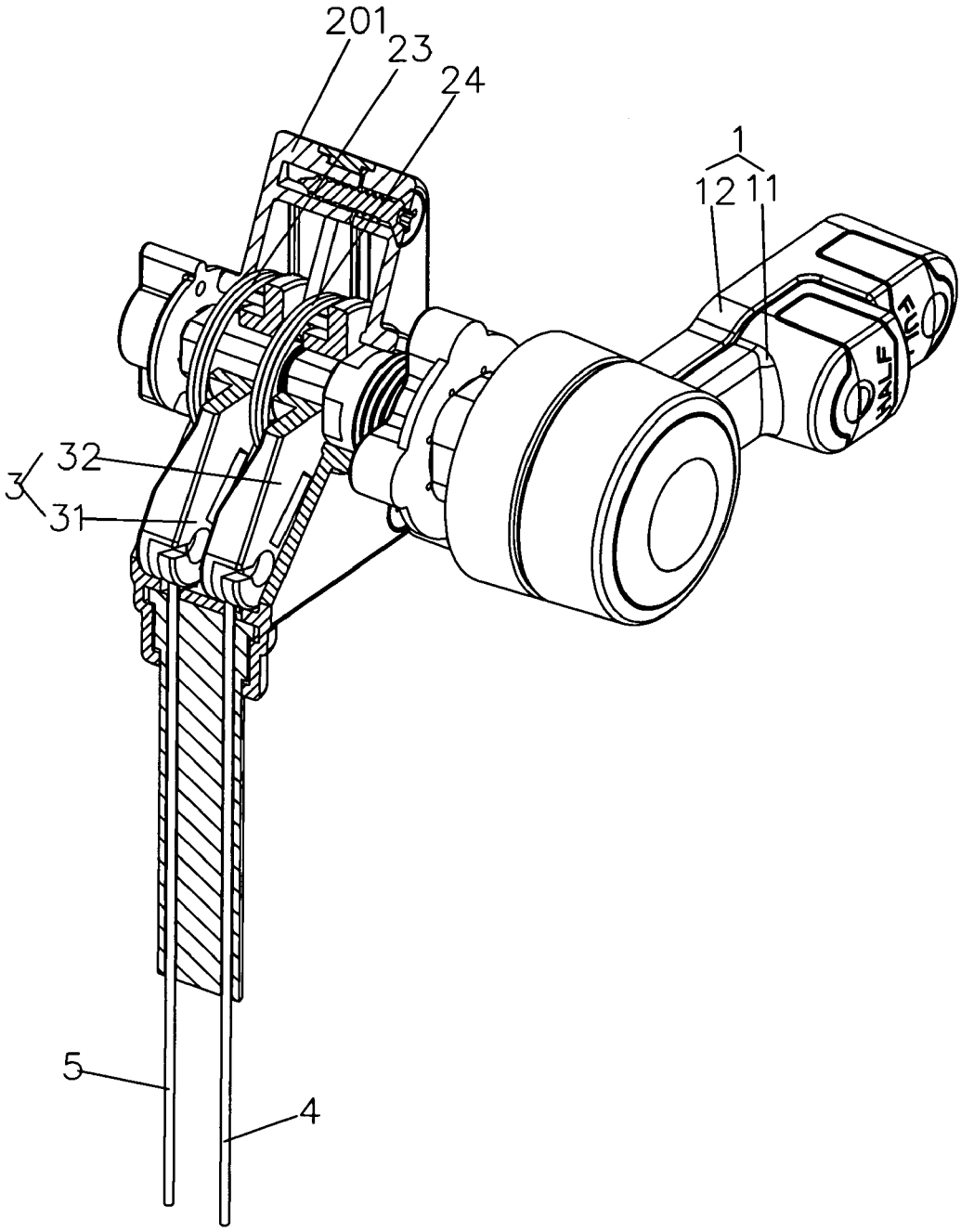
FIG. 4 is an assembled view of the present invention, partially sectioned.

As shown in FIG. 4, the partial discharge knob 11 is outward stacked on the whole discharge knob 12. The whole discharge knob 12 has an arm longer than that of the partial discharge knob 11. An inner end of the rotatable shaft unit 2 is inserted into a control box 201. A torque spring 23 is provided between the shaft core 21 and an inner wall of the control box 201. The torque spring 23 is adapted to link the shaft core 21 and the partial discharge knob 11 to return their original positions after the partial discharge. A torque spring 24 is provided between the shaft sleeve 22 and the inner wall of the control box 201. The torque spring 24 is adapted to link the shaft sleeve 22 and the whole discharge knob 12 to return their original positions after the whole discharge.

Figure 5:
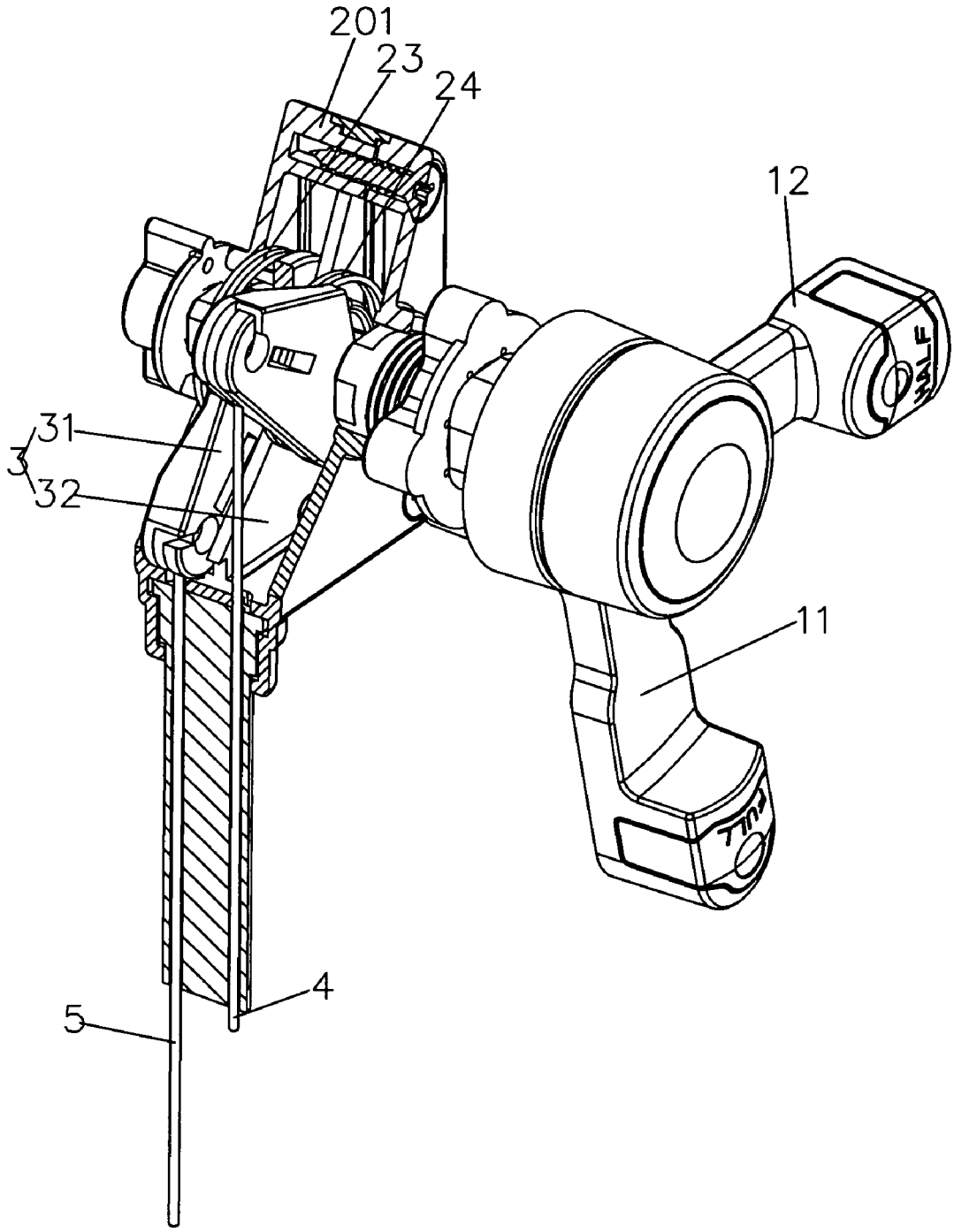
FIG. 5 is an assembled view of the present invention in an operating state for a whole discharge, partially sectioned.
Figure 12:
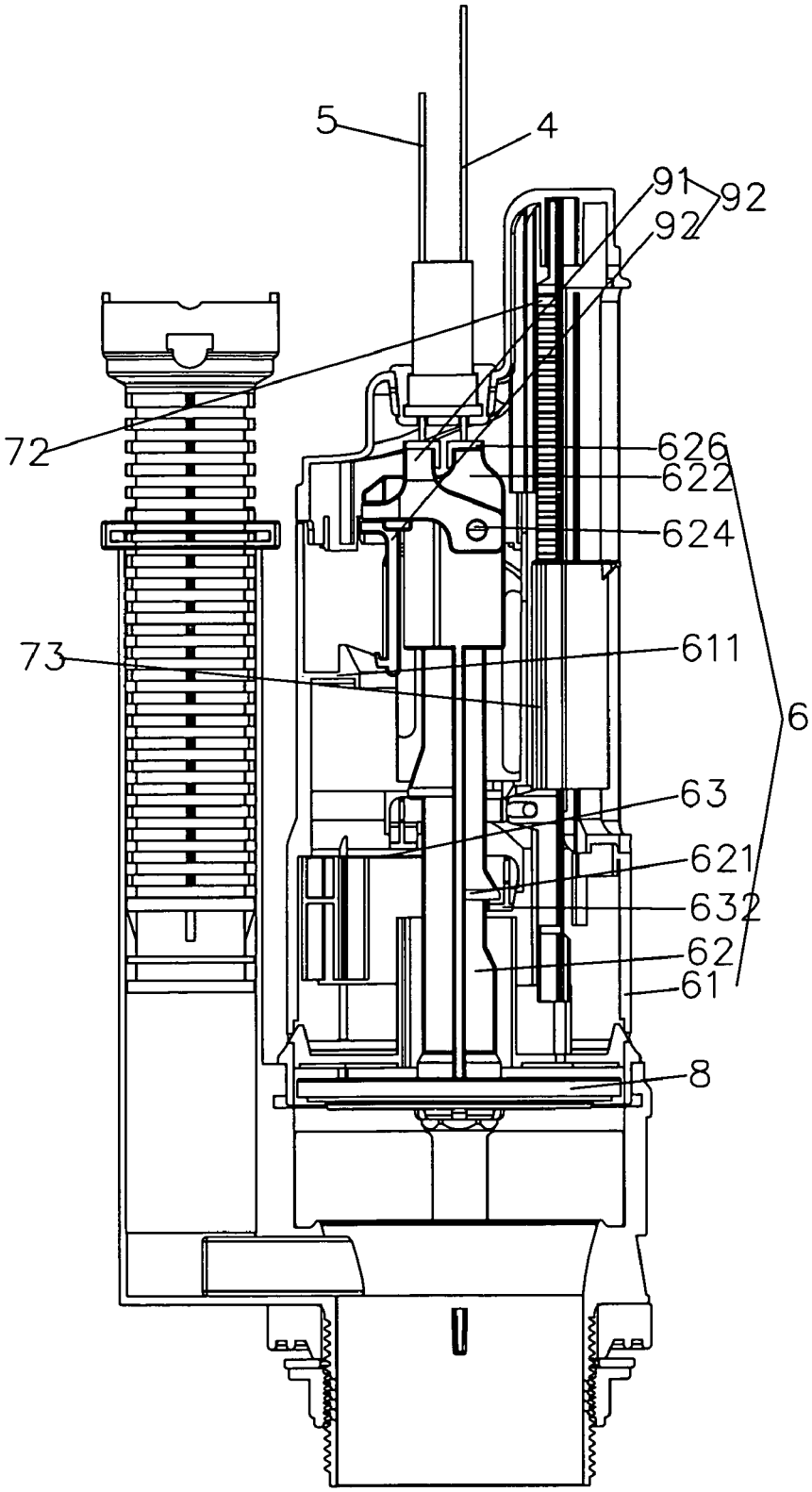
FIG. 12 is a partial side view of the present invention in an operating state for the whole discharge.

FIGS. 5 and 12 show the whole discharge of the present invention. The whole discharge knob 12 is rotated to link the shaft sleeve 22, the whole discharge pole 32, the whole discharge pull wire 4, and the whole discharge assembly 6, and the water seal 8 is lifted to a higher lever to achieve the whole discharge. FIGS. 6 and 13 show a partial discharge of the present invention. The partial discharge knob 11 is rotated to link the shaft core 21, the partial discharge pole 31, the partial discharge pull wire 5, and the partial discharge assembly 7, and the water seal 8 is lifted to a lower lever to achieve the partial discharge. The whole discharge and the partial discharge are separately controlled by the whole discharge knob 12 and the partial discharge knob 11, which is not easily confused in use to avoid any wrong operation. The whole discharge knob 12 and the partial discharge knob 11 are rotated outward at the same direction, which is convenient for installation and operation. This design conforms to a usual practice to rotate the knob outward. The present invention relates to the improvements in the knob unit 1, the rotatable shaft unit 2, and the pole unit 3, without consideration to the whole discharge pull wire 4, the partial discharge pull wire 5, the whole discharge assembly 6, the partial discharge assembly 7, and the water seal 8 which are not limited as shown in this embodiment. This design is adapted to all kinds of toilet tank valves for whole and partial discharges.

Figure 10:
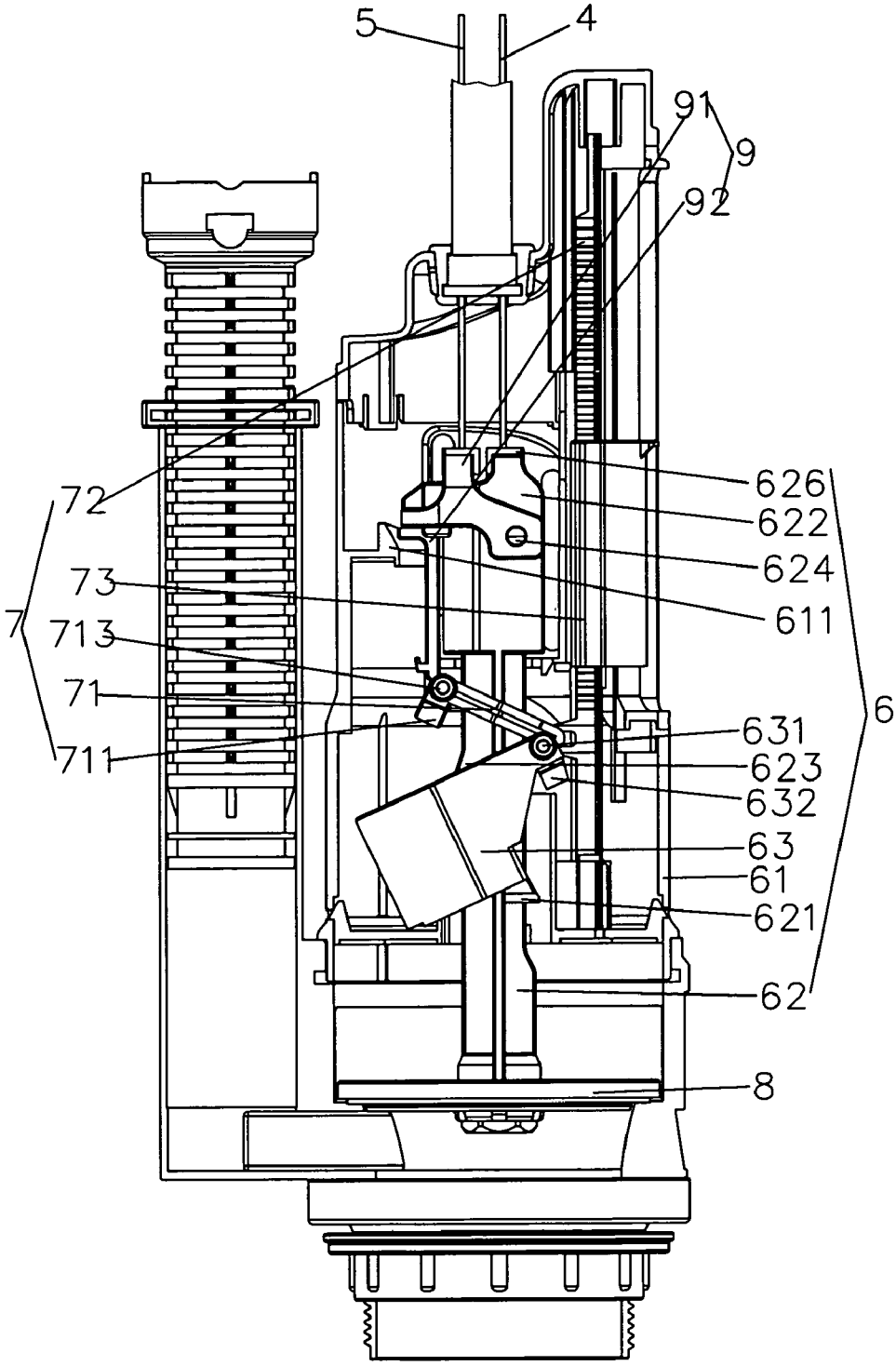
FIG. 10 is a partial side view of the present invention when there is no water in the toilet tank.

As shown in FIGS. 7, 8, 11 and 12, the whole discharge assembly 6 in this embodiment comprises a body 61, an inner tube 62, and a whole discharge float 63. The inner tube 62 and the whole discharge float 63 are assembled in the body 61. The whole discharge float 63 fits onto the inner tube 62. The whole discharge float 63 has one side pivotally connected to an inner wall of the body 61 through a pivot 631. As shown in FIG. 10, the whole discharge float 63 and the inner tube 62 are provided with corresponding limiting steps 632 and 621. A lower end of the whole discharge pull wire 4 is connected to an upper end of the inner tube 62. The bottom of the inner tube 62 is mounted onto the water seal 8. The top of the inner tube 62 is provided with an engaging base 622. An engaging claw 626 is provided on the engaging base 622. An engaging hole is formed between the engaging base 622 and the engaging claw 626 for insertion of the lower end of the whole discharge pull wire 4.

Figure 7:
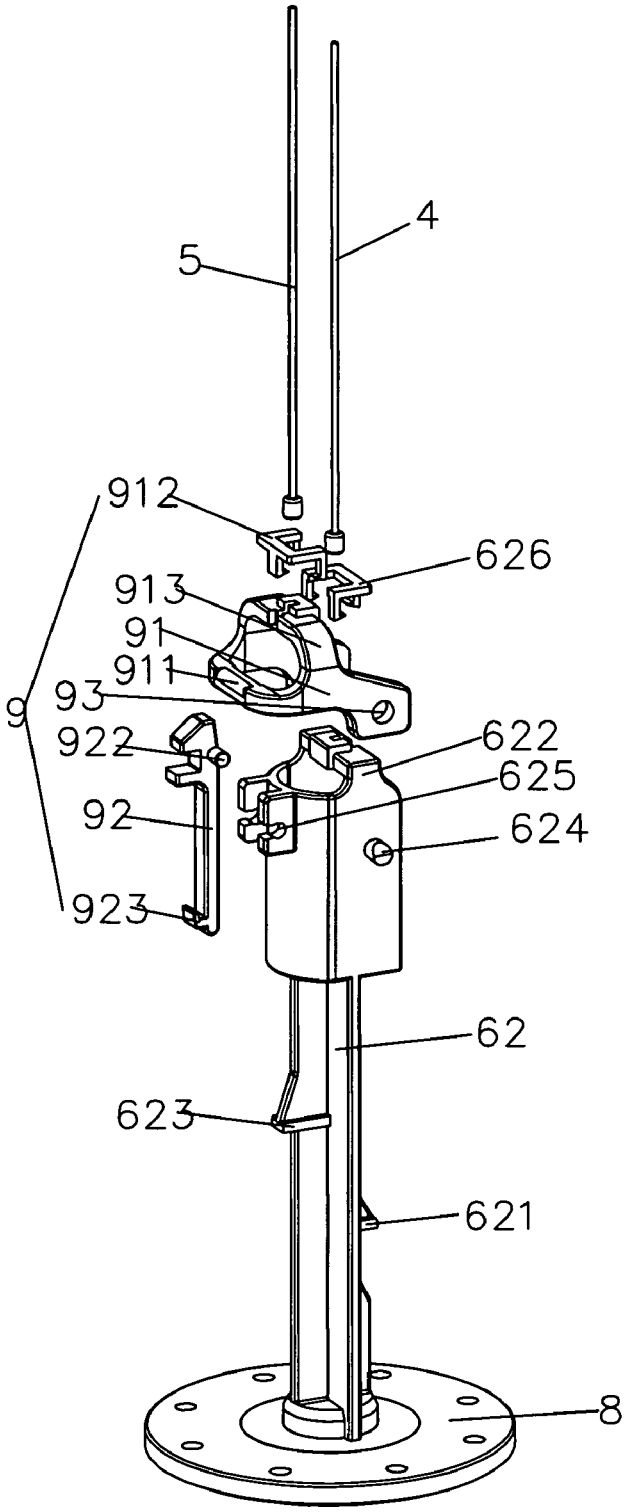
FIG. 7 is an exploded and enlarged view of a limiting device of the present invention.
Figure 8:
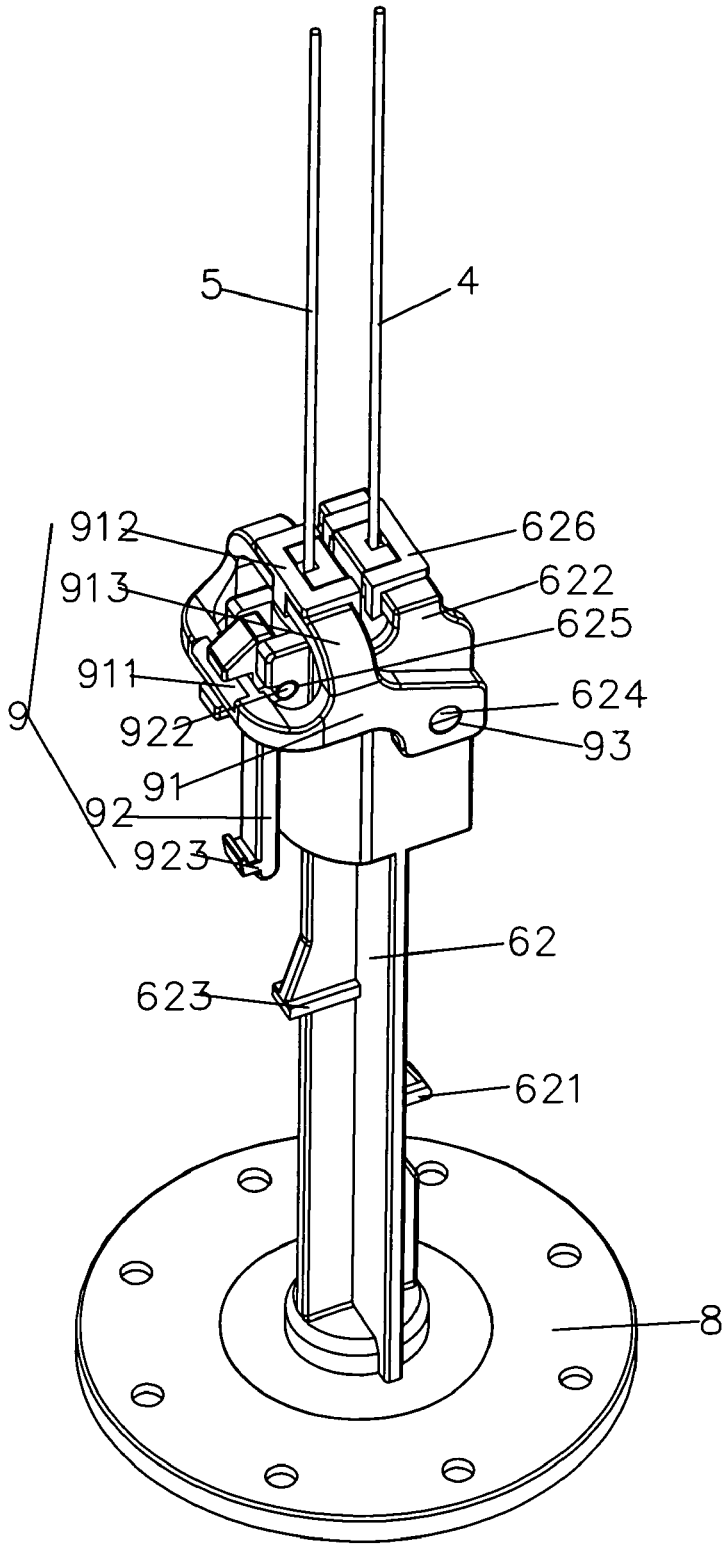
FIG. 8 is a perspective view of the limiting device of the present invention.

As shown in FIGS. 7, 8 and 10, the partial discharge assembly 7 in this embodiment comprises the body 61, the inner tube 62, a swing hook 71, a floating rod 72, and a partial discharge float 73. The floating rod 72 is inserted in the body 61 in an up and down movable way. The partial discharge float 73 20 is disposed on the floating rod 72 to change the level of the partial discharge float 73 with respect to the floating rod 72 so as to adjust the amount of discharge water. A first end of the swing hook 73 is pivotally connected to the floating rod 712 through a pivot 712, while a second end of the swing hook 73 is pivotally connected to a hole of the body 61. The second end of the swing 25 hook 73 and the inner tube 62 are provided with corresponding limiting steps 711 and 623. As shown in FIG. 13, the partial discharge pull wire 5 is connected to the inner tube 62 to achieve the partial discharge.

Figure 9:
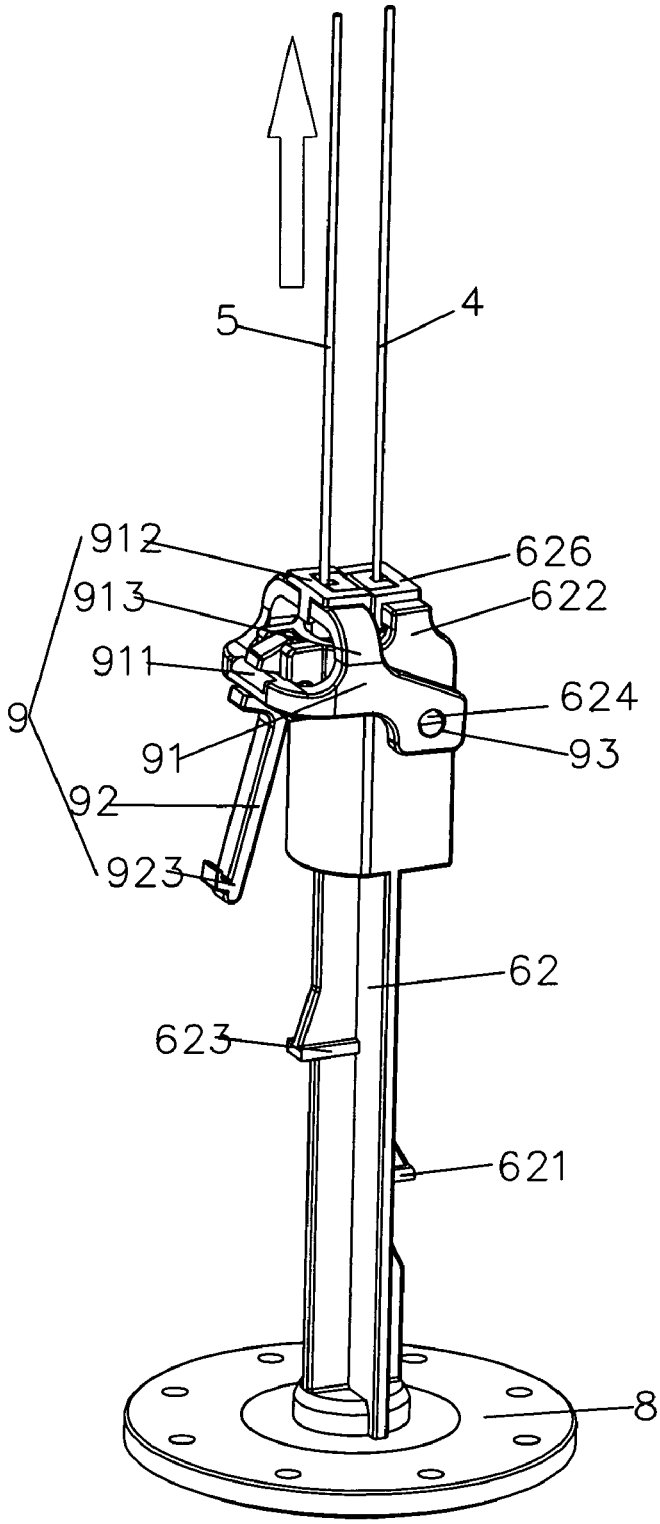
FIG. 9 is a perspective view of the limiting device of the present invention in an operating state for a partial discharge.

The second improvement of the present invention is that a limiting device 9 is provided between the partial discharge pull wire 5 and the partial discharge assembly 7. The limiting device 9 comprises a brake rod 91 and a limiting hook 92. As shown in FIG. 9, one side of the brake rod 91 is pivotally connected on the inner tube 62 by mean of a pivot 624 and a pivot hole 93. The other side of the brake rod 91 is connected to the partial discharge pull wire 5 and the limiting hook 92. An engaging base 913 is provided on the top of the brake rod 91, and an engaging claw 912 is provided on the engaging base 913. An engaging hole is formed between the engaging claw 912 and the engaging base 913 for insertion of the lower end of the partial discharge pull wire 5 to complete the connection of the brake rod 91 and the partial discharge pull wire 5. The other side of the brake rod 91 is provided with a pivot rod 911 while the limiting hook 92 is formed with a notch 921 to engage with the pivot rod 911 to complete the connection of the brake rod 91 and the limiting hook 92. An upper end of the limiting hook 92 is pivotally connected to the inner tube 62 by means of a pivot 922 and a pivot hole 625. A lower end of the limiting hook 92 is formed with a hooking part 923, and the inner wall of the body 61 is provided with a protruding step 611 for engagement of the hooking part 923.

Figure 11:
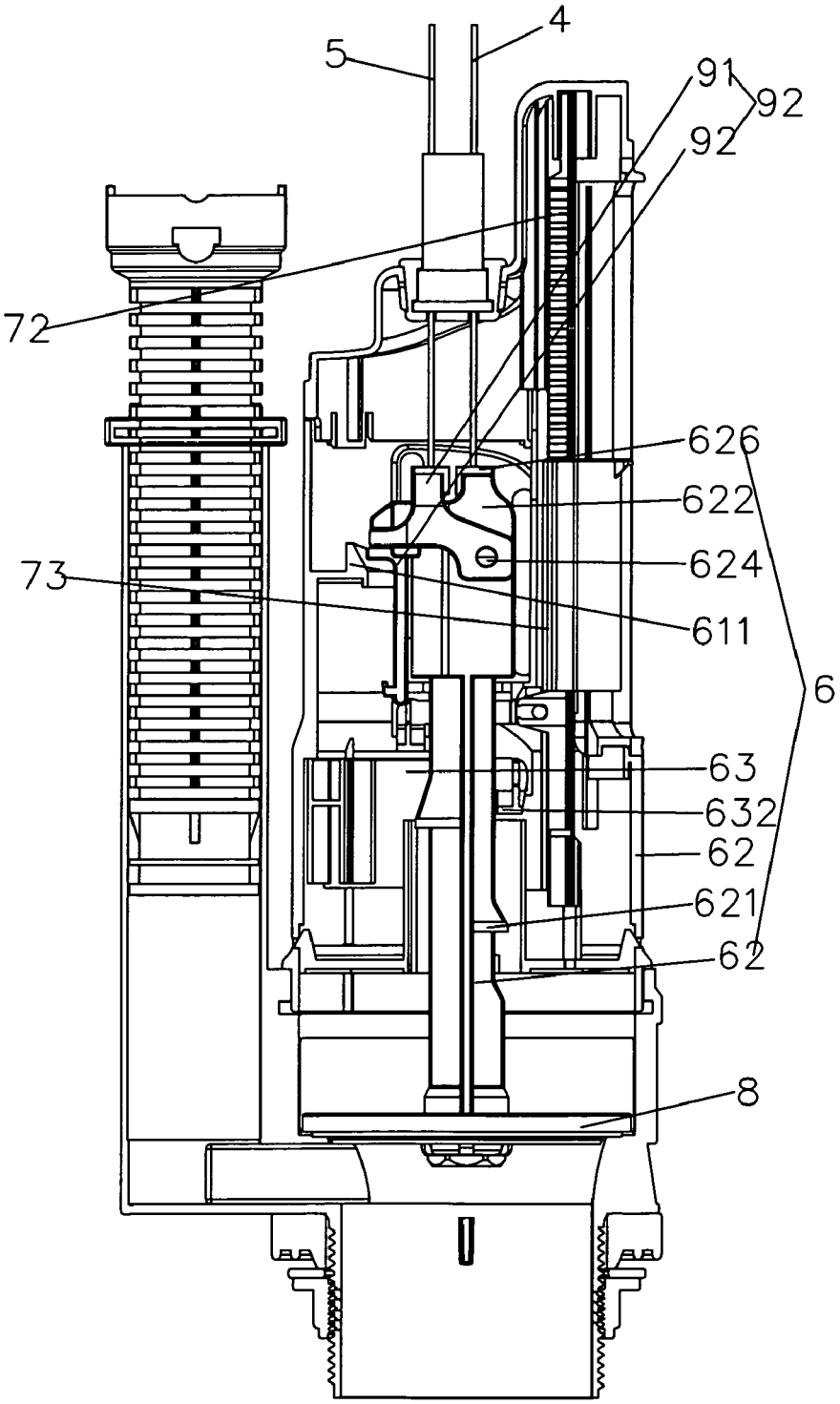
FIG. 11 is a partial side view of the present invention when the toilet tank is filled with water.

As shown in FIG. 10, the preferred embodiment of the present invention is installed in the toilet tank. When there is no water in the toilet tank, the partial discharge float 73 and the floating rod 72 are fallen down because of gravity to link the swing hook 71 to rotate around the pivot 71 in a tilted state. As shown in FIG. 11, when the toilet tank is filled with water, the partial discharge float 73 and the floating rod 72 are risen because of buoyancy to link the swing hook 71 to rotate around the pivot 712 in a level state. The whole discharge float 631 is deflected and rotated around the pivot 631 in a level state.

FIG. 12 shows the whole discharge of the present invention. The whole discharge knob 12 links the whole discharge pull wire 4 and the inner tube 62 to move upward, and then the water seal 8 is lifted to open the outlet of the toilet tank and to drain the water in the tank. When the inner tube 62 is pulled to a highest position and the whole discharge knob 12 is released, the inner tube 62 will slide downward until the limiting step 621 engages with the limiting step 632. As the inner tube 62 stops sliding, the water seal 8 is located at a higher position and continues to drain water until the level of the water in the tank is at the position that the gravity of the whole discharge float 63 is larger than buoyancy. The whole discharge float 63 is deflected around the pivot 631 to lean the limiting step 632. The limiting step 621 slides down from the limiting step 632, and the inner tube 62 continues to slide down until the water seal 8 covers the outlet again to achieve the whole discharge.

FIGS. 9 and 13 show the partial discharge of the present invention. The partial discharge knob 11 links the partial discharge pull wire 5 and the brake rod 91 to move upward. The brake rod 91 is rotated around the pivot 624. The inner tube 62 is lifted up through the brake rod 91 to link the water seal 8 to open the outlet of the toilet tank and to drain the water in the tank. The limiting hook 92 is rotated around the pivot 922, and the lower end of the limiting hook 92 is deflected to engage with the protruding step 611 in the body 61, which confines the limiting hook 92 to move upward continuously. The partial discharge knob 11 is confined to continuous rotation by means of the limiting device 9. When the partial discharge knob 11 is released, the inner tube 62 will slide down until the limiting step 623 engages with the limiting step 711. As the inner tube 62 stops continuing sliding down, the water seal 8 is located at a lower position and continues to drain water until the level of the water in the tank is at the position that the gravity of the partial discharge float 73 and the floating rod 72 is larger than buoyancy. The partial discharge float 73 and the floating rod 72 slide down because of gravity. The swing hook 71 is deflected and rotated around the pivot 631 to lean the limiting step 711. The limiting step 623 slides down from the limiting step 711, and the inner tube 62 continues to slide down until the water seal 8 covers the outlet again to achieve the partial discharge.

Accordingly, by the limiting device 9, the user is able to exactly operate the knob unit 1 for a whole discharge or a partial discharge.

Although the present invention has been shown and described with respect to the preferred embodiment, it will be understood by those skilled in the art that various changes and modifications may be made without departing from the spirit and scope of the invention as defined in the following claims.

What is claimed is:

1. A toilet tank valve structure, comprising a knob unit, a rotatable shaft unit, a pole unit, a whole discharge pull wire, a partial discharge pull wire, a whole discharge assembly, a partial discharge assembly, and a water seal; the knob unit comprising a partial discharge knob and a whole discharge knob; the rotatable shaft unit comprising a shaft core and a shaft sleeve; the pole unit comprising a partial discharge pole and a whole discharge pole; the whole discharge knob being secured to an outer end of the shaft sleeve, an inner end of the shaft sleeve being secured to a first end of the whole discharge pole, a second end of the whole discharge pole being connected to the whole discharge pull wire to link the whole discharge assembly and the water seal; the partial discharge knob being secured to an outer end of the shaft core, the shaft core being inserted into the shaft sleeve, an inner end of the shaft core being secured to a first end of the partial discharge pole, a second end of the partial discharge pole being connected to the partial discharge pull wire to link the partial discharge assembly and the water seal, wherein the partial discharge assembly comprises a body, an inner tube, a swing hook, a floating rod, and a partial discharge float, the partial discharge float being disposed on the floating rod, the floating rod being inserted in the body in an up and down movable way, a first end of the swing hook being pivotally connected to the floating rod, a second end of the swing hook being pivotally connected to an inner wall of the body, the swing hook and the inner tube being provided with corresponding limiting steps; a limiting device being provided between the partial discharge pull wire and the partial discharge assembly, the limiting device comprising a brake rod and a limiting hook, one side of the brake rod being pivotally connected on the inner tube, another side of the brake rod being connected to the partial discharge pull wire and the limiting hook, an upper end of the limiting hook being pivotally connected to the inner tube, a lower end of the limiting hook being formed with a hooking part, the inner wall of the body being provided with a protruding step for engagement of the hooking part.

2. The toilet tank valve structure as claimed in claim 1, wherein an engaging base is provided on the top of the brake rod and an engaging claw is provided on the engaging base, an engaging hole being formed between the engaging claw and the engaging base for insertion of a lower end of the partial discharge pull wire.

3. The toilet tank valve structure as claimed in claim 1, wherein the whole discharge knob is integrally formed with the shaft sleeve.

4. The toilet tank valve structure as claimed in claim 1, wherein the partial discharge knob is outward stacked on the whole discharge knob, and the whole discharge knob has an arm longer than an arm of the partial discharge knob.

5. The toilet tank valve structure as claimed in claim 1, wherein the rotatable shaft unit is inserted into a control box, a pair of torque springs being provided between the shaft core and an inner wall of the control box and between the shaft sleeve and the inner wall of the control box, respectively, the torque springs being adapted to link the shaft core and the shaft sleeve to return their original positions.

6. A toilet tank valve structure, comprising a knob unit, a rotatable shaft unit, a pole unit, a whole discharge pull wire, a partial discharge pull wire, a whole discharge assembly, a partial discharge assembly, and a water seal; the knob unit comprising a partial discharge knob and a whole discharge knob; the rotatable shaft unit comprising a shaft core and a shaft sleeve; the pole unit comprising a partial discharge pole and a whole discharge pole; the whole discharge knob being secured to an outer end of the shaft sleeve, an inner end of the shaft sleeve being secured to a first end of the whole discharge pole, a second end of the whole discharge pole being connected to the whole discharge pull wire to link the whole discharge assembly and the water seal; the partial discharge knob being secured to an outer end of the shaft core, the shaft core being inserted into the shaft sleeve, an inner end of the shaft core being secured to a first end of the partial discharge pole, a second end of the partial discharge pole being connected to the partial discharge pull wire to link the partial discharge assembly and the water seal, wherein the whole discharge assembly comprises a body, an inner tube, and a whole discharge float, the inner tube and the whole discharge float being assembled in the body, the whole discharge float fitting onto the inner tube, the whole discharge float having one side pivotally connected to an inner wall of the body, the whole discharge float and the inner tube being provided with corresponding limiting steps, the whole discharge pull wire being connected to an upper end of the inner tube, the bottom of the inner tube being mounted onto the water seal.

7. The toilet tank valve structure as claimed in claim 6, wherein the top of the inner tube is provided with an engaging base and an engaging claw is provided on the engaging base, an engaging hole being formed between the engaging base and the engaging claw for insertion of a lower end of the whole discharge pull wire.

* * * * *